US008069958B2

(12) United States Patent
Lence-Barreiro

(10) Patent No.: US 8,069,958 B2
(45) **Date of Patent: *Dec. 6, 2011**

(54) ELEVATOR SYSTEM AND METHOD INCLUDING A CONTROLLER AND REMOTE ELEVATOR MONITOR FOR REMOTELY PERFORMED AND/OR ASSISTED RESTORATION OF ELEVATOR SERVICE

(75) Inventor: Juan A. Lence-Barreiro, Madrid (ES)

(73) Assignee: Otis Elevator Company, Farmington, CT (US)

( * ) Notice: Subject to any disclaimer, the term of this patent is extended or adjusted under 35 U.S.C. 154(b) by 679 days.

This patent is subject to a terminal disclaimer.

(21) Appl. No.: 12/086,714

(22) PCT Filed: Jul. 18, 2005

(86) PCT No.: PCT/US2005/025527

§ 371 (c)(1),
(2), (4) Date: Nov. 26, 2008

(87) PCT Pub. No.: WO2007/011359

PCT Pub. Date: Jan. 25, 2007

(65) Prior Publication Data

US 2009/0218178 A1 Sep. 3, 2009

(51) Int. Cl.
*B66B 1/34* (2006.01)

(52) U.S. Cl. ..... 187/393; 187/247

(58) Field of Classification Search ..... 187/247, 187/248, 391–393

See application file for complete search history.

(56) References Cited

U.S. PATENT DOCUMENTS

| | | | | |
|---|---|---|---|---|
| 3,973,648 | A | 8/1976 | Hummert et al. | |
| 4,491,198 | A | 1/1985 | Noda et al. | |
| 4,697,243 | A | 9/1987 | Moore et al. | |
| 4,898,263 | A | 2/1990 | Manske et al. | |
| 4,930,604 | A * | 6/1990 | Schienda et al. | 187/393 |
| 5,557,546 | A * | 9/1996 | Fukai et al. | 702/185 |
| 6,330,935 | B1 * | 12/2001 | Systermans | 187/391 |

(Continued)

FOREIGN PATENT DOCUMENTS

JP 11035240 A 2/1999

(Continued)

OTHER PUBLICATIONS

Extended European Search Report for Application No. EP 05 77 8203 dated Aug. 25, 2011.

*Primary Examiner* — Anthony Salata
(74) *Attorney, Agent, or Firm* — Carlson, Gaskey & Olds PC

(57) ABSTRACT

An elevator (49) includes remote elevator monitoring equipment (50) (REM) connected by a communication linkage (52) to a central elevator monitoring and control station (51). Main, drive, and door controllers (56-58) are interconnected (5961) with the REM. Power-on-reset (POR) of controllers is caused internally (150) or by remotely-operable relays (63-65). An elevator expert at the remote station may order a POR (108), disable components (120), try various fixes (124), and/or order maintenance (115, 135) with instructions. In another embodiment, the controller (**56*a*, 56*b*) includes elevator diagnostics (150) which can recognize an elevator malfunction and either cause a relay (63**) to interrupt power for an interval or cause a reboot.

10 Claims, 4 Drawing Sheets

U.S. PATENT DOCUMENTS

| | | | | |
|---|---|---|---|---|
| 6,484,125 | B1 * | 11/2002 | Huang et al. | 702/183 |
| 6,604,611 | B2 * | 8/2003 | Liu et al. | 187/391 |
| 6,683,432 | B2 * | 1/2004 | Griffis | 318/568.16 |
| 7,073,633 | B2 * | 7/2006 | Weinberger et al. | 187/393 |
| 7,274,932 | B1 * | 9/2007 | Iyer | 455/423 |
| 7,350,626 | B2 * | 4/2008 | Lence et al. | 187/393 |
| 7,448,473 | B2 * | 11/2008 | Lindberg et al. | 187/392 |
| 7,482,771 | B2 * | 1/2009 | Hahn et al. | 318/272 |
| 7,505,914 | B2 * | 3/2009 | McCall | 705/1.1 |
| 7,699,142 | B1 * | 4/2010 | Wurth et al. | 187/391 |

FOREIGN PATENT DOCUMENTS

| | | | |
|---|---|---|---|
| JP | 2005015167 | A | 1/2005 |
| JP | 20051124886 | A | 4/2005 |

* cited by examiner

FIG.3
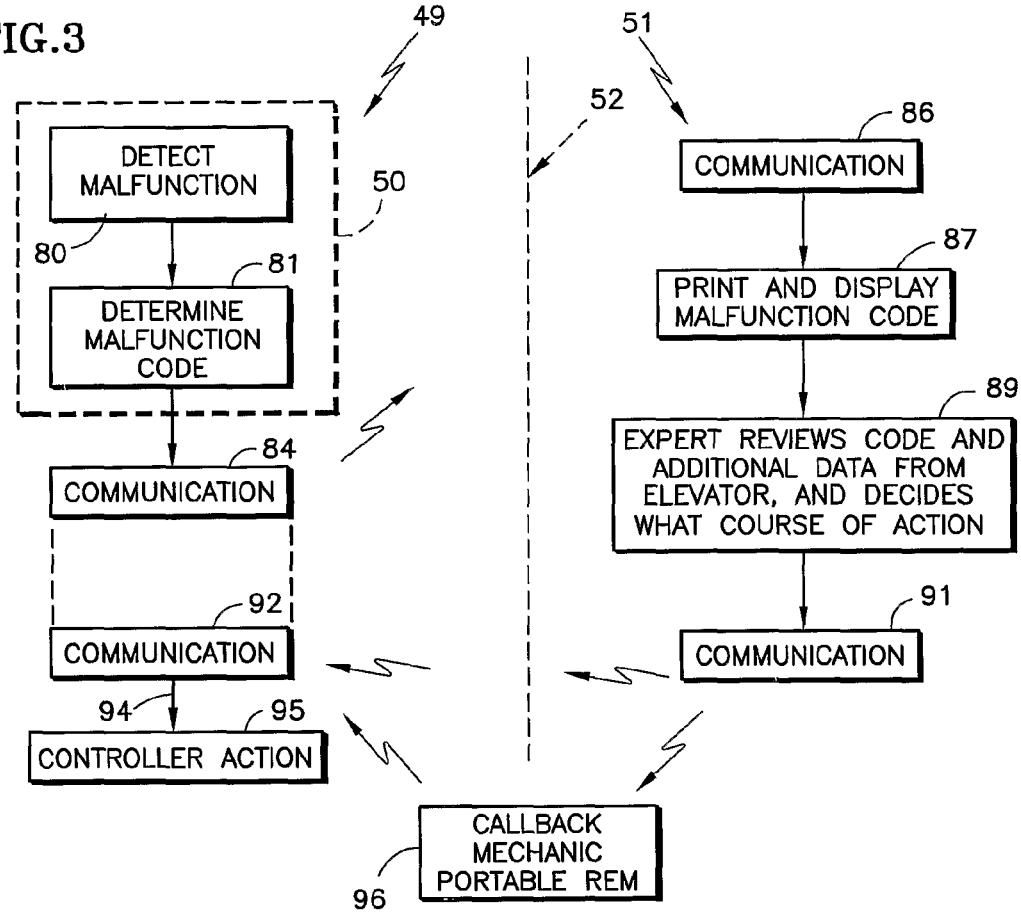
FIG.5
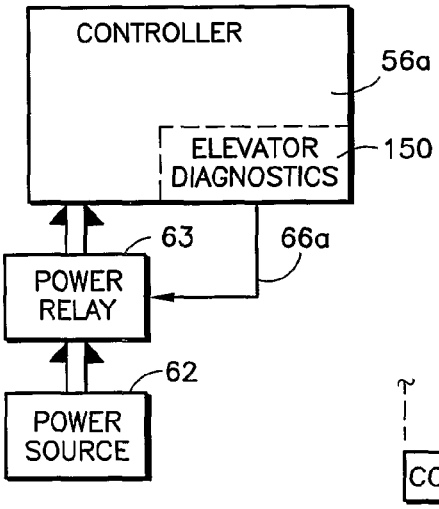
FIG.6
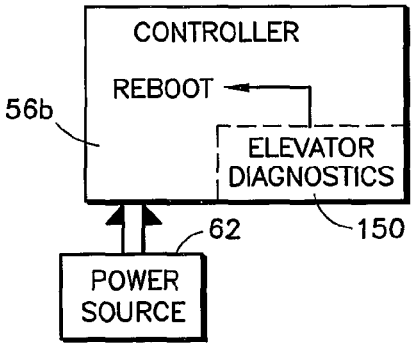
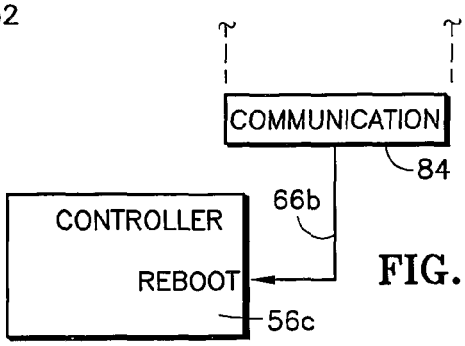
FIG.7

ELEVATOR SYSTEM AND METHOD INCLUDING A CONTROLLER AND REMOTE ELEVATOR MONITOR FOR REMOTELY PERFORMED AND/OR ASSISTED RESTORATION OF ELEVATOR SERVICE

TECHNICAL FIELD

This invention relates to remote elevator monitoring (REM) of elevator conditions, responding to indications of malfunctions in the elevator system by analyzing elevator statii and conditions remotely; determining: that an urgent maintenance call ("callback") would be ineffective, that the elevator is running, that a scheduled maintenance call may be substituted for a callback, that the utility power grid is the problem, or that the controller is malfunctioning, and the like; correcting certain problems remotely without a service call, such as by causing a power-on reset or disabling a non-critical component so the car will run; and/or providing expert analysis at the remote site for use by a responding service mechanic.

BACKGROUND ART

Remote elevator monitors (REMs) have become common. The status of various elements and various operational parameters of the elevator are typically sent by a communication link, which may be telephone or some other media, to a central monitoring and control station. Remote elevator monitoring of this sort may be as disclosed in U.S. Pat. Nos. 4,568,909, 4,622,538, 5,450,478, and more modern systems which have evolved therefrom.

A typical prior art response to an elevator malfunction that requires immediate attention is illustrated in FIG. 1. When a malfunction is reported by an elevator owner 23 or by a REM 24, a service mechanic is assigned 25, 26 to an urgent service call to the site of the elevator, referred to hereinafter as a "callback". When a service call is assigned to a callback mechanic, it is placed on his/her queue 27 with other service calls, without any knowledge of whether it is a five minute repair or a longer repair. Further, the emergency or harmful nature of the call may generally not be known; for instance, car or hallway doors may be continuously opening and closing in a repetitive fashion. Many times, the callback mechanic will arrive on site 30 and the elevator will be working 31, with no failure being apparent 32. If the callback mechanic can provide a repair 36 he will do so, and report the incident with a callback code 37. If nothing is to be done, he simply reports 39 that the elevator was running on arrival.

At times, the problem with the elevator is simply the fault of the electric power being supplied over the grid by a utility company. Frequently, the call will be answered without the necessary repair part, and at times, the callback mechanic will not have sufficient knowledge to determine what the problem really is; in such cases, a second callback is required to restore elevator service. In many cases, the callback mechanic may be able to perform some simple function on site to restore elevator operation, which does not justify the delay, waiting for the callback mechanic before restoring service, nor the time spent by the callback mechanic, including traveling. Service calls are also costly.

DISCLOSURE OF INVENTION

Principal objects of the invention are to either not issue (or to cancel) a callback, or to determine the true root cause of the problem before the callback is serviced. Other objects include: reducing the number of service calls required by elevators being monitored; reducing the cost of restoring elevator service after malfunctions have been reported; reducing the time required to correct an elevator malfunction; avoiding unnecessary service calls to elevator sites; providing corrective action without a service call when possible; and improved elevator monitoring and servicing.

This invention is predicated on the recognition that a significant number of elevator service calls are unnecessary, only involve a faulty power source, are not served properly due to lack of information about the malfunction before reaching the site, require no more than a power on reset of one or more controllers (main controller, door controller, or drive controller), and/or result only in disabling an elevator component to safely restore substantial service. The invention is also predicated on the recognition that many elevator malfunctions can be corrected more quickly by remote means than by actual on-site involvement.

According to the present invention, remote elevator monitoring equipment, of the type which is customary, may be utilized with modification in accordance herewith for one or more of: determining the true root cause of a service call without automatically creating a callback request, determining if the problem is a failure of the power source or if the car is operating, entering hall or car calls to see if the car will operate, determining when a power-on reset of a controller may be effective and causing the same, determining when the request reflects a true non-working condition of the elevator, operating doors remotely to determine if a recorded door failure is true, determining elevator condition by remotely entering a car call or a landing call, determining if the problem is that the car has tripped a final limit switch and moving the car away from the limit switch once the car is secured, determining and causing disablement of a landing with malfunctioning doors, disabling other malfunctioning, non-safety-critical components, finding the true root cause of a service request, providing expert information to the callback mechanic, informing the callback mechanic of possible necessary parts before the callback is performed, and not ordering a callback if none is needed.

In accordance further with the invention, an elevator malfunction, detected either by a related elevator controller or remote elevator monitoring equipment, for which a power on reset (POR) of the controller may provide either a cure or additional information useful in determining the cure of the malfunction, is accomplished without the aid of on-site maintenance personnel either by interrupting the electric power supplied to the controller or by causing the controller to perform an internal POR or reboot.

According to this aspect of the invention in one form, reset of a power relay (which may consist of a moveable armature switch or electronic switches) of an elevator controller (which may comprise a main controller, a door controller, a drive controller, etc.) is accomplished without the aid of on-site maintenance personnel by remotely operating a remotely operable power relay from which the controller derives power; the power relay of the controller may be operated by (a) remote monitoring and control personnel sending a signal over a communication link, by (b) on-site elevator monitoring equipment, or by (c) computer programs which perform elevator diagnostics within the controller itself.

According to this aspect of the invention in another form, an elevator controller is caused to be re-booted (in a manner similar to a control/alt/delete re-boot in a personal computer), without the aid of on-site maintenance personnel; the re-boot may be caused by (a) remote monitoring and control personnel sending a signal over a communication link, by (b) on-site elevator monitoring equipment providing a signal to the controller, by (c) computer programs which perform self-test within the controller itself.

This aspect of the invention allows providing a power-on reset without the intervention of on-site maintenance personnel, in response to monitoring equipment or off-site personnel determining an elevator malfunction which a POR may cure, or concerning which a POR may provide additional, useful service information. Examples of malfunctions for which a POR is not useful include a problem with a load weighing device or an open safety chain.

In further accord with the invention, a non-safety-critical elevator component or mode is disabled, either remotely or by directing a callback mechanic to do so, whenever a malfunction, detected either by a related elevator controller or remote elevator monitoring equipment, is indicated as caused by such component and that disablement will not prevent the elevator from safely providing substantial elevator service. Disabling such non-safety-critical components (including modes of operation) reduce service in an obvious way, but allow safe operation of the elevator to provide a substantial amount of service.

Among such components are car call buttons and landing call buttons; if call buttons are disabled, passengers will either not be able to enter from such a floor unless the car stops there to deliver a passenger, or would not be able to exit on a floor unless the car stopped there to pick up a passenger. Such components also include: the between-door passenger sensor (such as a light ray device), a disablement of which only means that the passenger will be touched (but not hurt) by the door or doors unless the door open button is pressed. The load weighing device is another component which may be disabled in most elevators without any effect, but may reduce ride quality and/or hall call dispatching quality in other cases. A disabled landing door simply prevents access to a given floor, other floors remaining accessible. A disabled independent operation switch leaves the elevator under group control. Disabled door open and door close buttons cause the controller to operate the doors. Disabled door close and open limit switches require the controller to use other limits, such as time (e.g., 3.5 sec) to end door travel. Temperature sensors may raise the risk of component failure (such as the drive motor) if disabled, but do not create any present danger to passengers. There are certain elevator modes (such as V.I.P. service) or parameters (such as timer periods) which may be altered. If the car has tripped the upper or lower travel limit switch, the car can be determined safe (e.g., empty or door closed) and then moved to a floor, doors opened and an announcement made; then the corresponding highest or lowest floor disabled from service. Maintenance, such as brake service may be ordered. Or, if the car operates the limit switch properly, no further action need be taken.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 3 is a functional illustration of response to a report of an elevator malfunction in accordance with the invention.

FIG. 5 is a simplified, stylized block diagram of an embodiment of the invention in which the controller provides its own power-on-reset.

FIG. 6 is a simplified, stylized block diagram of an embodiment of the invention in which the controller re-boots itself.

FIG. 7 is a partial, simplified, stylized block diagram of an embodiment of the invention in which the controller is caused to be re-booted remotely.

MODE(S) FOR CARRYING OUT THE INVENTION

Figure 1:
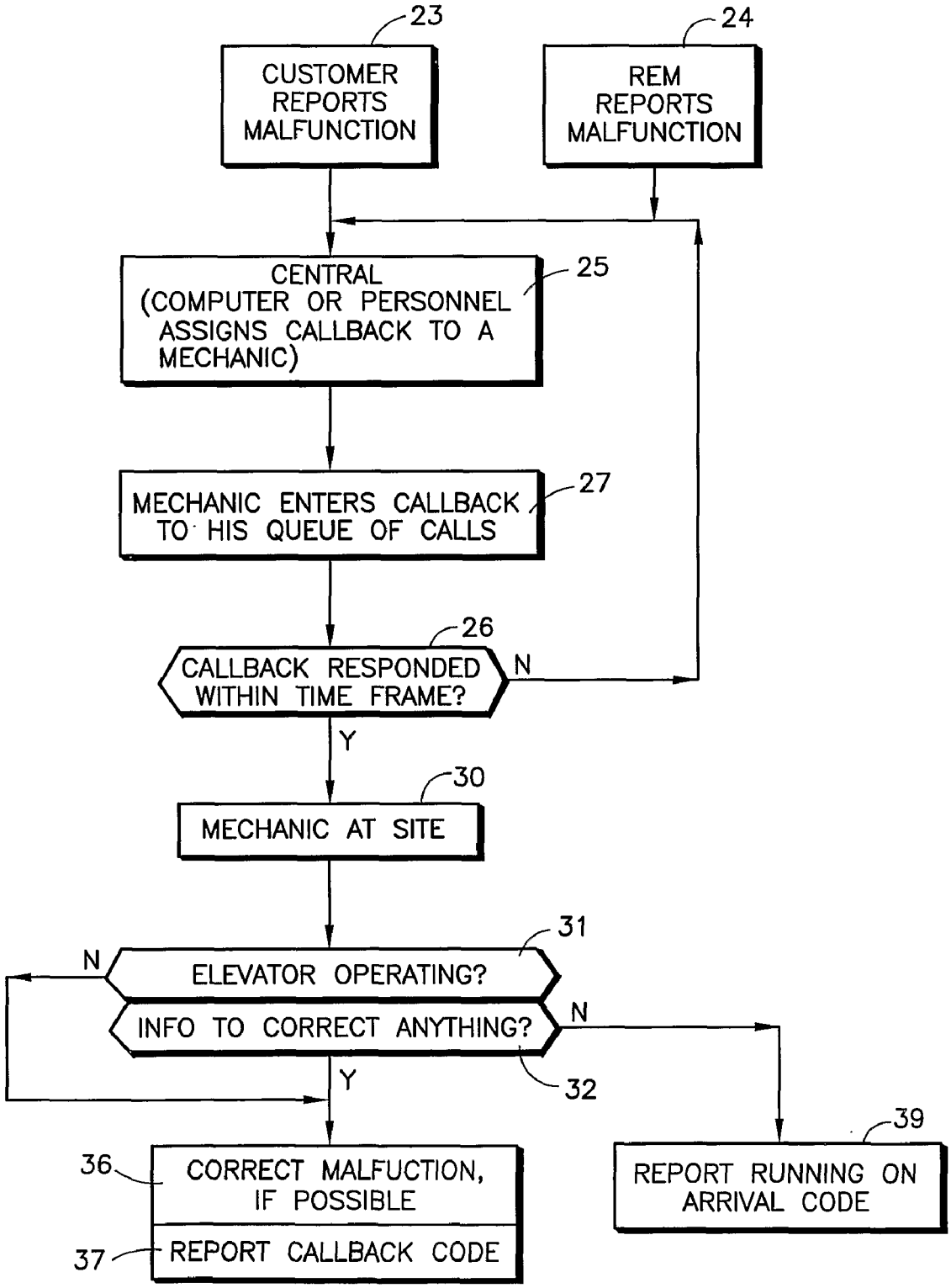
FIG.1 Prior Art
FIG. 1 is a functional chart of typical prior art response to a report of an elevator malfunction.
Figure 2:
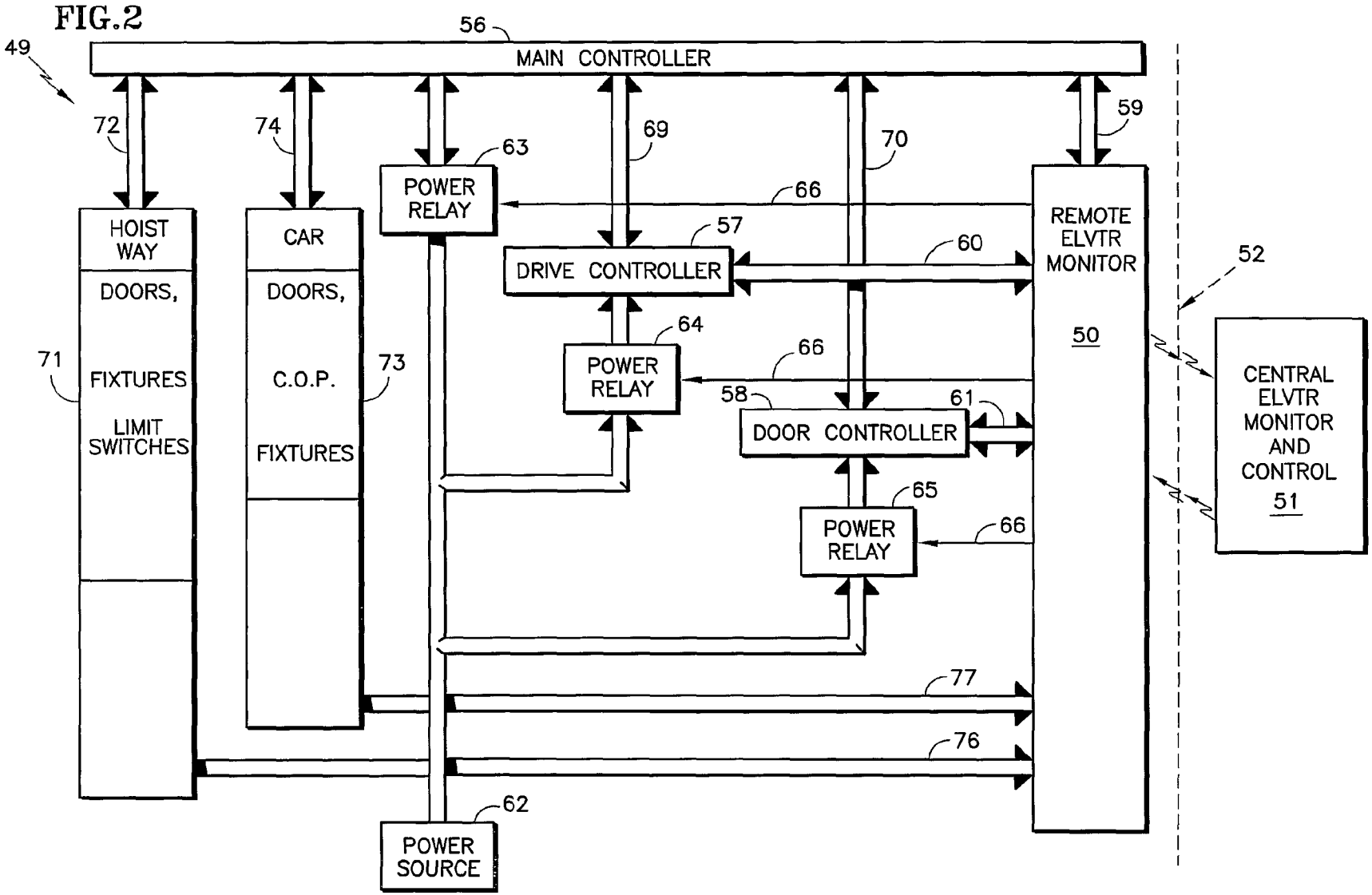
FIG. 2 is a simplified, stylized block diagram of an elevator system employing a remote elevator monitor in communication with a central station, in accordance with the present invention.

Referring to FIG. 2, an elevator system 49 includes a remote elevator monitor 50 which communicates with a central elevator monitoring and control station 51 over communication linkage 52, which may be telephone, RF, infrared or any other desired medium.

The elevator 49 has a main controller 56 and may also have a drive controller 57 and/or a door controller 58; except as described hereinafter, the controllers 56-58 are conventional in some embodiments; the door and/or drive controller are connected with the remote elevator monitoring equipment 50 via signal lines 59-61, respectively. According to one aspect of the invention in one form, each of the controllers 56-58 receives electrical power from a source 62 (such as a power utility grid) through a corresponding remotely operable power relay 63-65, connected to the remote elevator monitor 50 by lines 66. The invention may be practiced with less than all of the controllers 56-58 being powered by remotely operable power relays 63-65, or, more than one controller may be powered by a single relay. In some cases, there may be only one controller in an elevator; similarly, there may be only one power relay per elevator.

The drive and door controllers 57, 58 are connected with the main controller through signals lines 69, 70, respectively. The doors, fixtures, limit switches, etc. of the hoistway 71 are connected with the main controller 56 by signal lines 72. The doors, car operating panel and fixtures of the car 73 are connected with the main controller 56 by signal lines 74. The hoistway 71 and the car 73 are also connected to the remote elevator monitor 50 by means of signal lines 76, 77, respectively.

Referring to FIG. 3, in one embodiment of the invention, the remote elevator monitoring equipment 50 will determine 80, 81 that a malfunction has occurred and its code, and send that code over the communication linkage 52 to the central elevator monitoring and control station 51 by means of a suitable communication unit 84, which may be a modem. The remote monitoring and control station 51 will receive the malfunction code through communication equipment 86, which may comprise a modem, and typically will have steps 87 to print and display the malfunction code.

In the prior art, the malfunction code would have been viewed by personnel who would only assign the callback to a mechanic, or a callback would have been assigned automatically by a remote controller.

In accordance with the invention, in a next step 89 of the process of this embodiment, an elevator expert reviews the malfunction code and additional data which has periodically been sent by the REM 50 to the central station 51. Such data may be conveniently organized, stored and displayed in accordance with U.S. Pat. No. 6,330,936 by Lence-Barreiro et al, indicating other statii and operating conditions of the elevator. From this, the expert decides 49 what action to take and will decide what may possibly cure the malfunction or provide useful information. If the maintenance personnel presses one or more switches, makes a keyboard entry, or otherwise indicates what action should be taken at the site, such will be transmitted through communication equipment 91, which may be a modem, over the communication linkage 52, and received by a communication unit 92. A signal over one or more lines 94 causes one or more controllers to perform a step 95 causing an event (POR, disable component, etc.).

The communication units 84, 92 will typically comprise send and receive modes of a single modem, as will the units 86, 91. The central station may alternatively communicate with an assigned callback mechanic through a portable REM 96.

Figure 4:
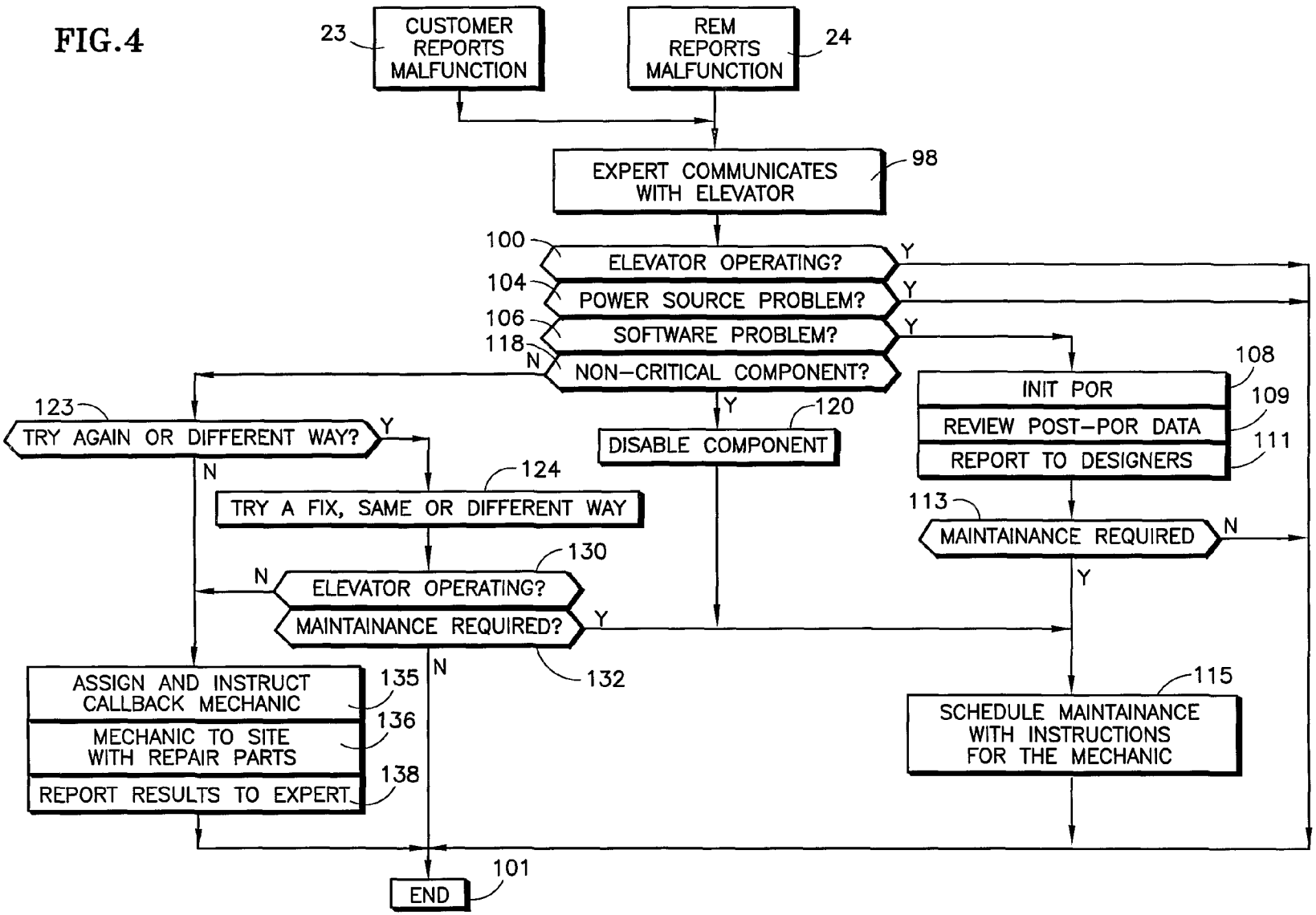
FIG. 4 is a simplified diagram of functions which may be performed in carrying out the operational strategy of the invention in response to a report of an elevator malfunction.

Referring to FIG. 4, either the customer 23 or the REM 24 may report a malfunction. In that case, the expert within the central elevator monitor and control station 51 will communicate 98 with the elevator in a manner described with respect to FIG. 3. The expert will determine if the elevator is operating, such as by remotely entering a car call or a hall call and watching the response of the elevator to his call. If the elevator is responding, a corresponding test 100 will be affirmative and the expert will do nothing further, reaching the end of the routine 101. It is to be noted that the remote elevator monitoring equipment has already sent the data and it has been recorded as described hereinbefore. Therefore, if the elevator is operating, its condition is already known and any problems of a routine nature can be handled at the next scheduled maintenance.

Should the elevator not be operating, a test 104 will determine whether the power source 62 is the problem. If there is something wrong with the power, such as phase, under voltage, over voltage and so forth, which the controller 56 will have already detected, then there is nothing to be done until the power problem is resolved. Therefore, an affirmative result of the test 104 will cause the program to end 101. In this embodiment, the powering of any controllers may be initially established by the central elevator monitor and control station 51, and interrupted when appropriate in response to elevator malfunctions.

If the power source 62 is not a problem, then a test 106 determines whether there is a software problem. If so, the expert will communicate a power on reset to the main controller 56 through the remote elevator monitor 50. The apparatus will typically be set up so that the power will remain off for some significant fraction of a minute or other suitable interval, and then the relay will be operated so as to restore power to the controller, thereby achieving a conventional POR of the computer. This will cause at least some change in what is being reported by the remote elevator monitor 50.

Then, the expert will review 109 the post-POR data to learn more about the problem, if appropriate. If there is useful information, the expert will cause such information to be reported 111 to the elevator designers at an engineering center. The expert will also determine 113 if maintenance is required. If so, the expert will schedule maintenance 115 in a manner that includes instructions for the mechanic, as to the most likely components which have caused the malfunction and such spare parts as might be needed in order to restore normal operation. On the other hand, if no maintenance should be scheduled, the program will end 101.

If there is not a software problem, then the expert will determine 118 if the problem is caused by a non-safety-critical component. The term "component" includes more than a single apparatus and functions that involve software as well. Such components include, but are not limited to, the following: car call and/or landing call buttons; between-door sensor, such as a light ray device (or equivalent); the load weighing device; a landing door; the independent operation switch; door open and/or close buttons; door open and/or close limit switches; certain modes of elevator operation, such as timers, and temperature sensors.

If there is a non-safety-critical component (as described hereinbefore) that has failed, then the expert will remotely disable 120 that component, and the expert will schedule maintenance 115. In the case of upper or lower travel limit switches, disabling the component means disabling the ability of the car to service calls at the highest or lowest floor, respectively.

If all of the decisions 100, 104, 106, 118 are negative, there is need for further response, with no easy fix. The expert may then decide (test 123) to try a fix remotely, either one he has already tried, or in a different way. If so, the expert will cause the try, either the same or different, in a step 124. As an example, if an elevator door fails to open, the elevator will be in an idle state with its door (or doors) closed. The controller will have been trying to power the door motor in the opening direction; however, this cannot be continued for an extended time because it would damage the door motor. But the expert may remotely command the door or doors to open in order to observe parameters such as if the door is moving at least a little bit, or, if the door is moving enough to unlock the door lock. If the door does move, the expert can observe how long it takes before it closes again. To try something in a different way, in this case, could mean not to try to open the door, but to try to close it. Or, the expert could move the elevator to another floor and try operating the door or doors there. Another action could be to change the configuration of the door in the controller so that the commands and the signals used to effectuate the commands are different. If any of these attempts to rectify or circumvent the problem are successful, then a test 130 will determine that the elevator is operating and a test 132 will determine whether maintenance is required to fully resolve the problem. If so, the step 115 is reached so that maintenance is scheduled with instructions for the mechanic.

If test 123 is negative, or if test 130 is reached and it is negative, then the expert will assign a callback mechanic and provide instructions as indicated in a step 135. Step 136 indicates the mechanic will then go to the site of the elevator with repair parts and attempt to correct the malfunction. Thereafter, the callback mechanic will report the result of his visit to the expert, as indicated in step 138.

The apparatus of FIG. 2 may have a different mode of operation in which the remote elevator monitoring equipment 50, at the site of the elevator 49, may itself determine that the code of a malfunction indicates one which a POR may cure or provide useful information, and cause a POR signal on one or more of the lines 66 to a corresponding one or more of the power relays 63-65.

FIG. 5 illustrates an additional embodiment of the invention in which the main controller **56*a* has, within its own programming routines, elevator diagnostics 150, which identify an elevator malfunction for which a POR is appropriate, and is able to transmit a signal on a line 66*a* to the power relay 63 to cause power to the controller 56*a*** to be removed for an interval and then restored.

Referring to FIG. 6, another embodiment of the invention includes a controller **56*b* which receives power directly from the source 62, rather than through a power relay. In this embodiment, the elevator diagnostic programming routines 150** will command the controller to re-boot (POR) itself.

In FIG. 7, the communication unit 84 provides a signal on a line 66*b* to command a controller 56*c* to re-boot itself. In a variation of the embodiment of FIG. 7, the remote elevator monitor 50 may itself command the controller 56*c* to re-boot (POR) itself whenever the monitor 50 senses a malfunction for which a re-boot may be useful in either providing a cure or causing additional information relative to the status and conditions of the elevator to assist in determining the cure.

Thus, the invention may either interrupt the power to the controller, or cause the controller to re-boot itself.

The invention claimed is:

1. A method of responding to a report of a malfunction, in an elevator (49) powered from a source (62) and having at least one controller (56-58), without human intervention at the site of the elevator, which method is characterized by one or more of:

(a) causing said one or more controllers, upon determining a malfunction, to temporarily interrupt (66*a*, 66*b*) the power from said source;

(b) causing said controller to perform diagnostic routines and in response to a corresponding indication from said diagnostic routines, causing said controller to reboot (150) itself; and (c) providing a remote elevator monitor (50) at the site of said elevator which monitors operational parameters of said elevator, including reports of malfunctions, and communicates (52, 84, 86) said reports of malfunctions and at least some others of said operational parameters to a central elevator monitor and control station (51), remote from said elevator site, and in response to a report of malfunction (23, 24) (i) determining at said central station if the elevator is running (100) or if the power from said source is outside limits (104) of voltage or phase and in such cases causing no further response to the report of malfunction, (ii) determining at said central station if the malfunction is in controller software (106) and if so remotely communicating from said central station a power-on-reset (108) to said elevator, (iii) determining at said central station if a malfunction is due to failure (118) of a non-safety-critical component and if so disabling (120) said component from said central station, (iv) remotely commanding (124), by communication with said elevator from said central station, one or more functions of said elevator one or more times and/or in different ways to determine (130) at said central station if said elevator can be brought into operation, or (v) determining at said central station when on-site service is required (123, 132) and providing from said central station instructions (115, 136) for a mechanic concerning the most likely cause of the malfunction and action most likely to remedy the malfunction.

2. A method according to claim 1 further characterized by:

an elevator expert at said remote station, who observes (89) said reports of malfunctions and said others of said operational parameters, said expert communicating (91, 98) with said elevator, and who, in response to a report of a malfunction, performs at least one of said steps (i)-(v).

3. A method according to claim 1 wherein said non-safety-critical component is selected from door open button, door close button, a landing door, a car call button, a landing call button, a between-door passenger sensor, a load weighing device, an independent operation switch, a door open limit switch, a door close limit switch, a V.I.P. or other mode of operation, and upper and lower travel limit switches.

4. A method of providing potentially corrective action to an elevator system (49) in response to elevator operation diagnostics (50) sensing (24) a malfunction, said elevator system having at least one controller (56-58) and at least one car (73) movable in a hoistway (71), characterized by:

causing a power-on-reset (POR) of one or more controllers in said elevator system by a process of operating, independent of human intervention at the site of the elevator system, said process comprising one or more of (a) a maintenance person informed of said malfunction (87) through communication linkage (52, 84, 86) causing said POR (66*b*) from a site remote from the elevator by means of communication linkage (91, 92) or (b) having on-site elevator monitoring equipment (50) cause (66) said POR when said monitoring equipment senses an elevator malfunction for which a POR may cure the elevator malfunction or provide information which may aid in determining the cause of the malfunction, or (c) providing, in program routines of said at least one controller (56*a*, 56*b*), elevator diagnostics (150) which cause said POR (66*a*, REBOOT) in response to recognition of an elevator malfunction for which a POR may cure the elevator malfunction or provide information which may aid in determining the cause of the malfunction.

5. A method according to claim 4 further comprising:

providing electric power (62) to said at least one controller through a remotely operable power relay (63-65); and causing (66, 66*a*) said POR by operating at least one said power relay to remove power from at least one said controller for an interval and to then restore power to said at least one controller.

6. A method according to claim 1 wherein:

said POR is performed internally of said controller (56*b*).

7. An elevator system comprising:

an elevator (49) serving a site, said elevator powered from a source (62) and having at least one controller (56-58);

a remote elevator monitor (REM) (50) at said site; and a central elevator monitor and control station (51) remote from said site, said REM monitoring operational parameters of said elevator, including reports of malfunctions, and communicating said reports of malfunctions and at least some others of said operational parameters to said central elevator monitor and control station;

characterized by:

means, operable by an elevator expert who communicates with said elevator and observes said reports of malfunctions and said others of said operational parameters, for (i) determining at said central station if the elevator is running or if the power from said source is outside limits (104) of voltage or phase and in such cases causing no further response to the report of malfunction, (ii) determining at said central station if the malfunction is in controller software (106) and if so remotely communicating from said central station a power-on-reset (108) to said elevator, (iii) determining at said central station if a malfunction is due to failure of a non-safety-critical component (118) and if so disabling said component (120) from said central station, (iv) remotely commanding, by communication with said elevator from said central station, one or more functions (124) of said elevator one or more times and/or in different ways to determine at said central station if said elevator can be brought into operation, or (v) determining at said central station when on-site service is required (123, 132) and providing from said central station instructions (115, 135) for a mechanic concerning the most likely cause of the malfunction and action most likely to remedy the malfunction.

8. An elevator system, comprising:

an elevator (49) having at least one controller (56-58) and at least one car (73) movable in a hoistway (71);

an elevator diagnostic function disposed in either or both of (i) said controller (56*a*, 56*b*) and/or (ii) a remote elevator monitor (50); and means operable in response to said diagnostic function sensing an elevator malfunction for which a power-on-reset (POR) of at least one said controller may cure the elevator malfunction or provide information which may aid in determining the cause of the malfunction for (66, 66*a*, 66*b*, REBOOT) causing a POR in at least one said controller, said means comprising one or more of (a) a tool (51, 96) remote from said elevator, controlled by maintenance personnel (89, 98; 96) informed of said malfunction through communication linkage (52, 84, 86) and operable over communication linkage (91, 92), or (b) on-site elevator monitoring equipment (50), or (c) said at least one controller (56*a*, 56*b*) performing elevator diagnostic (150) program routines.

9. An elevator system according to claim 8 further comprising:

one or more remotely-operable power relays (63-65) providing electric power to one or more said controllers (56-58); and wherein said means (51, 96; 50; 56*a*, 56*b*) causes (66, 66*a*) said POR by operating at least one said power relay to remove power from said at least one controller for an interval and then to restore power to said at least one controller.

10. A system according to claim 8 wherein:

said means (51, 96; 50; 56*a*, 56*b*) causes at least one said controller to perform an internal POR (REBOOT).

* * * * *